US011161260B2

(12) United States Patent
Schekalla et al.

(10) Patent No.: US 11,161,260 B2
(45) Date of Patent: Nov. 2, 2021

(54) KNIFE

(71) Applicant: MARTOR KG, Solingen (DE)

(72) Inventors: Peter Schekalla, Wuppertal (DE); Martin Herlitz, Remscheid (DE); Martin Rohrbach, Horn (DE)

(73) Assignee: MARTOR KG, Solingen (DE)

( * ) Notice: Subject to any disclaimer, the term of this patent is extended or adjusted under 35 U.S.C. 154(b) by 0 days.

(21) Appl. No.: 14/432,915

(22) PCT Filed: Oct. 2, 2013

(86) PCT No.: PCT/DE2013/000559

§ 371 (c)(1),
(2) Date: Apr. 1, 2015

(87) PCT Pub. No.: WO2014/053114

PCT Pub. Date: Apr. 10, 2014

(65) Prior Publication Data

US 2015/0258695 A1 Sep. 17, 2015

(30) Foreign Application Priority Data

Oct. 2, 2012 (DE) ..... 102012019107.3
Feb. 15, 2013 (EP) ..... 13000781

(51) Int. Cl.
*B26B 1/08* (2006.01)
*B26B 5/00* (2006.01)

(52) U.S. Cl.
CPC ..... *B26B 1/08* (2013.01); *B26B 5/00* (2013.01); *B26B 5/001* (2013.01); *B26B 5/003* (2013.01)

(58) Field of Classification Search
CPC .. B26B 1/08; B26B 5/00; B26B 5/001; B26B 5/003; B26B 1/10
USPC ..... 30/161, 125, 335, 2, 337, 339, 162, 124
See application file for complete search history.

(56) References Cited

U.S. PATENT DOCUMENTS 3,593,417 A * 7/1971 West ..... B26B 5/001 30/125
4,240,202 A * 12/1980 Gilbert ..... B26B 5/002 30/162
4,320,576 A * 3/1982 Beermann ..... B26B 1/08 30/162
4,604,805 A * 8/1986 Krieger ..... B26B 5/00 30/125

(Continued)

FOREIGN PATENT DOCUMENTS

DE WO 2011150907 A1 * 12/2011 ..... B26B 5/001
DE 102010051575 A1 * 5/2012 ..... B26B 5/001
WO 2012065586 A 5/2012

*Primary Examiner* — Jason Daniel Prone
(74) *Attorney, Agent, or Firm* — Andrew Wilford

(57) ABSTRACT

A knife has a first part and a second part movably engaged to the first part along a path between an open position in which a housing interior is accessible and a closed position. A holding surface is fixed on and jointly slidable with the second part, and a third part is fixable on the first part, An actuator is movable on the second part between an actuated position and an unactuated position. An arm integral with or fixed on the third part is operatively engaged by the actuator and displaced on movement of the actuator between the unactuated position and the actuated position between a locking position securing the second part in one of the open and closed positions and a release position.

8 Claims, 9 Drawing Sheets

(56) References Cited

U.S. PATENT DOCUMENTS 5,966,817 A * 10/1999 Lee ..... B26B 5/001 30/162
6,192,589 B1 * 2/2001 Martone ..... B26B 5/001 30/125
6,678,958 B1 * 1/2004 Budrow ..... B26B 5/001 30/162
7,621,051 B2 * 11/2009 Ping ..... B26B 5/00 30/162
7,647,702 B2 * 1/2010 Polei ..... B26B 5/001 30/162
7,784,189 B2 * 8/2010 Polei ..... B26B 5/003 30/162
7,987,602 B2 * 8/2011 Kanemoto ..... B26B 5/001 30/152
8,069,571 B2 * 12/2011 Chung ..... B26B 5/00 30/162
8,468,702 B2 * 6/2013 Doeren ..... B26B 5/003 30/162
8,793,881 B2 8/2014 Rowlay
8,819,942 B2 * 9/2014 Chung ..... B26B 1/08 30/162
8,997,358 B2 * 4/2015 Huang ..... B26B 5/001 30/162
9,770,833 B2 * 9/2017 Schekalla ..... B26B 5/001
D821,174 S * 6/2018 Rohrbach ..... 8/99
10,112,312 B2 * 10/2018 Schekalla ..... B26B 5/003
10,300,616 B2 * 5/2019 Schekalla ..... B26B 5/003
10,434,668 B1 * 10/2019 Kollias ..... B26B 1/10
D865,479 S * 11/2019 Rohrbach ..... 8/99
10,478,977 B2 * 11/2019 Rohrbach ..... B26B 1/08
10,814,505 B2 * 10/2020 Schekalla ..... B26B 5/003
10,899,026 B2 * 1/2021 Herlitz ..... B26B 5/003
2011/0283543 A1 * 11/2011 Wu ..... B26B 5/001 30/162
2012/0073142 A1 * 3/2012 Zeng ..... B26B 5/001 30/162
2012/0102754 A1 * 5/2012 Garavaglia ..... B26B 5/00 30/162
2013/0091712 A1 * 4/2013 Schekalla ..... B26B 1/08 30/162
2013/0199047 A1 * 8/2013 Herlitz ..... B26B 1/08 30/162
2013/0205598 A1 * 8/2013 Doeren ..... B26B 5/001 30/151
2016/0288343 A1 * 10/2016 Huang ..... B26B 1/08
2020/0198158 A1 * 6/2020 Arvinte ..... B26B 1/08

* cited by examiner

KNIFE

CROSS REFERENCE TO RELATED APPLICATIONS

This application is the US-national stage of PCT application PCT/DE2013/000559 filed 2 Oct. 2013 and claiming the priority of German patent application 102012019107.3 itself filed 2 Oct. 2012 and European patent application 13000781.8 itself filed 15 Feb. 2013.

FIELD OF THE INVENTION

The invention relates to a knife. Such a knife is described in DE 10 2009 032 362 [U.S. Pat. No. 8,468,702].

BACKGROUND OF THE INVENTION

The knife comprises a housing, on which a knife blade is supported. A second housing part of the housing is designed such that it can be moved relative to a first housing part and in this way displaced between a closed position and an open position. A housing interior can be accessed in the open position.

OBJECT OF THE INVENTION

The invention is based on the objective of developing a knife that can be easily manufactured and assembled. The invention furthermore aims to develop a knife that comprises a small number of parts.

SUMMARY OF THE INVENTION

This object is attained by a knife that comprises a housing and a blade. The housing comprises a first housing part and at least one second housing part, and the second housing part can be fixed on the first housing part. For example, the second housing part is separably held on the first housing part. The second housing part can be moved relative to the first housing part such that the housing interior can be accessed, for example in order to carry out a blade change. The second housing part can at least be moved relative to the first housing part between an open position and a closed position.

In at least one position, for example in the closed position, the second housing part can be separably locked on the first housing part by a locking mechanism. The locking mechanism can be moved between a locking position and a release position. In the locking position, the second housing part is locked relative to the first housing part in at least one direction, i.e. immovable in at least one direction. In the release position, the second housing part can be moved relative to the first housing part in at least one direction.

The locking mechanism comprises cooperating locking means that are indirectly or directly associated with the first and the second housing part. For example, the locking means are fixed directly on the first housing part or on the second housing part. The locking means may alternatively or additionally be fixed on a supplementary part that in turn is fixed on the first or the second housing part. The locking means are engaged in the locking position. In the locking position, the housing part cannot be moved relative to the other housing part in at least one direction. The locking means are disengaged in the release position. In the release position, the housing part can be moved relative to the other housing part.

The locking means comprise a movable arm with at least one locking surface, wherein the locking surface can be separably moved into the moving path of at least one holding surface of the second locking means. The arm can be moved between the locking position and the release position. In the locking position of the arm, the locking surface is situated in the moving path of the holding surface. In the release position, the locking surface is moved out of the moving path of the holding surface. When the locking surface is situated in the moving path of the holding surface, the second housing part cannot be moved relative to the first housing part in at least one direction. The holding surface of the second locking means is realized, for example on a projection of the second housing part. The arm is prestressed into the locking position, for example by a restoring force such as the force of a separate spring or the restoring force of the material of the arm. When the arm is moved into the release position, it automatically moves back into the locking position as soon as the force prestressing the arm into the locking position decreases.

According to an embodiment, the arm comprises a free end. The arm is realized, for example integrally with a housing part or with a supplementary housing part fixed on the housing part. For example, the free end of the arm protrudes into an interior of the housing. The arm extends, for example parallel to a longitudinal housing axis. For example, the free end points in the direction of the blade outlet opening of the housing.

The locking surface is associated, for example with the free end of the arm. For example, the locking surface is arranged on a face side of the free end.

For example, the arm is prestressed into the locking position. The arm may be prestressed into the locking position, for example by a spring element. Alternatively, the arm is made of an elastically deformable material that after a deformation returns to the original shape due to its restoration force.

According to an embodiment, the arm can be adjusted between the locking position and the release position by an actuating mechanism. The actuating mechanism is associated, for example with the second housing part. The actuating mechanism can be adjusted between an idle position and an actuated position.

According to an embodiment, the actuating mechanism is formed by an elastic tab that is cut free of one of the housing parts. For example, the tab is fixed on a housing part on one side and has a free end that can be elastically deformed.

The locking means are formed, for example by cooperating snap-on means. The snap-on means are automatically engaged, for example when the housing parts are situated in a certain position relative to one another. For example, the arm automatically engages with the locking surface when the housing parts are moved into the closed position.

The arm is associated, for example with a third housing part that is fixed on the first and/or on the second housing part by a fixing device. For example, the third housing part is separably fixed on another housing part. The arm particularly is realized or fixed on the third housing part. The fixing device is realized, for example in the form of a snap-on mechanism. For example, the arm may be integrally connected to the third housing part.

An embodiment is characterized in that the third housing part forms a fixing means and/or locking means and/or supporting means and/or holding means. For example, the third housing part may feature locking means that limit the movement of one housing part relative to another housing part in at least one moving direction.

According to an embodiment, first fixing means are formed on the third housing part and cooperate with second fixing means associated with the first housing part and/or the second housing part. The third housing part may be fixed on the first and/or on the second housing part in this way. The fixing means may be formed, for example by cooperating snap-on means.

For example, supporting means are realized on the third housing part and serve for supporting the blade support or for forming an abutment for the blade support. In addition, holding means are realized, for example on the third housing part in order to fix a spring.

According to an embodiment, for example, one housing part has first guiding means that cooperate with second guiding means of at least one other housing part in order to guide the housing part relative to the other housing part along a moving path. The cooperating guiding means form a guiding device. One of the housing parts may be movably guided relative to the other housing part along a moving path with the aid of the guiding means. For example, one housing part can be moved relative to the other housing part and guided into its seat along a moving path. The guiding means make it possible, for example, to move the second housing part relative to the first housing part between the closed position and at least the open position. A third housing part that forms an arm is guided, for example on the first or the second housing part with the aid of the guiding means and in this way moved into a seat. The guiding means of a housing part may be realized, for example on opposite longitudinal sides of the housing part and cooperate with guiding means of another housing part that are realized complementary. The guiding means may be formed, for example by at least one web realized on one housing part, wherein the web can be displaced in a sliding fashion in a groove realized on the other housing part. The guiding means may limit the degree of freedom of the relative movement between the housing parts.

According to an embodiment of the invention, one of the housing parts has first stopping means that cooperate with stopping means of another housing part in order to limit the movement of the housing part relative to the other housing part in at least one moving direction. For example, two housing parts are guided by a guiding device such that they can be moved relative to one another along a moving path. A movement in at least one direction can then be prevented in a certain relative position with the aid of the stopping means. In addition, a relative movement between the housing parts in a second direction can be prevented by the locking mechanism when this locking mechanism is in the locking position. For example, the movement of the second housing part relative to the first housing part in a first direction is in the closed position prevented by the locking surface of the arm when the arm is in the locking position. The movement of the second housing part relative to the first housing part in a second direction is in the closed position prevented, for example by cooperating limit stops of the housing parts. The arm can be moved into the release position such that the locking surface is moved out of the moving path of the holding surface. The second housing part can then be moved in the first direction.

For example, the first guiding means and the second guiding means form a slotted link. For example, the slotted link forms a guide, on which one housing part can move relative to the other housing part along the slotted link only.

According to an embodiment, the second housing part or the third housing part forms a slotted link together with the first housing part. For example, the second housing part or the third housing part can be displaced into a seat by the slotted link.

The seat is defined, for example by cooperating stopping means of the housing parts that are guided on one another and displaced into a seat in the form of a guided movement by the slotted link.

BRIEF DESCRIPTION OF THE DRAWING

Other advantages of the invention are elucidated below with reference to an illustrated embodiment illustrated in the figures. In these figures.

SPECIFIC DESCRIPTION OF THE INVENTION

In the figures, the inventive knife is altogether identified by the reference symbol 10. Identical parts are in the different figures identified by the same reference symbols, namely also if small letter is added or omitted.

Figure 1:
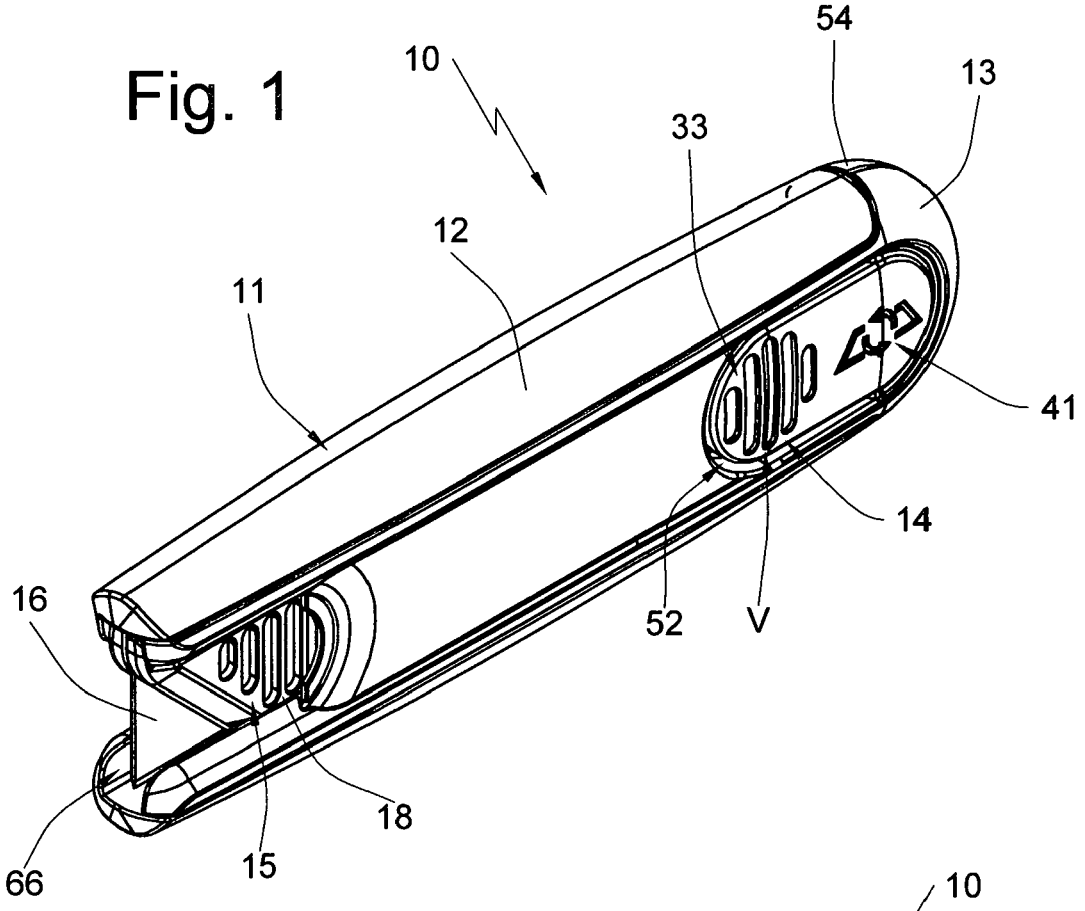
FIG. 1 is a schematic perspective view of a knife, in which a second housing part is in the closed position.
Figure 2:
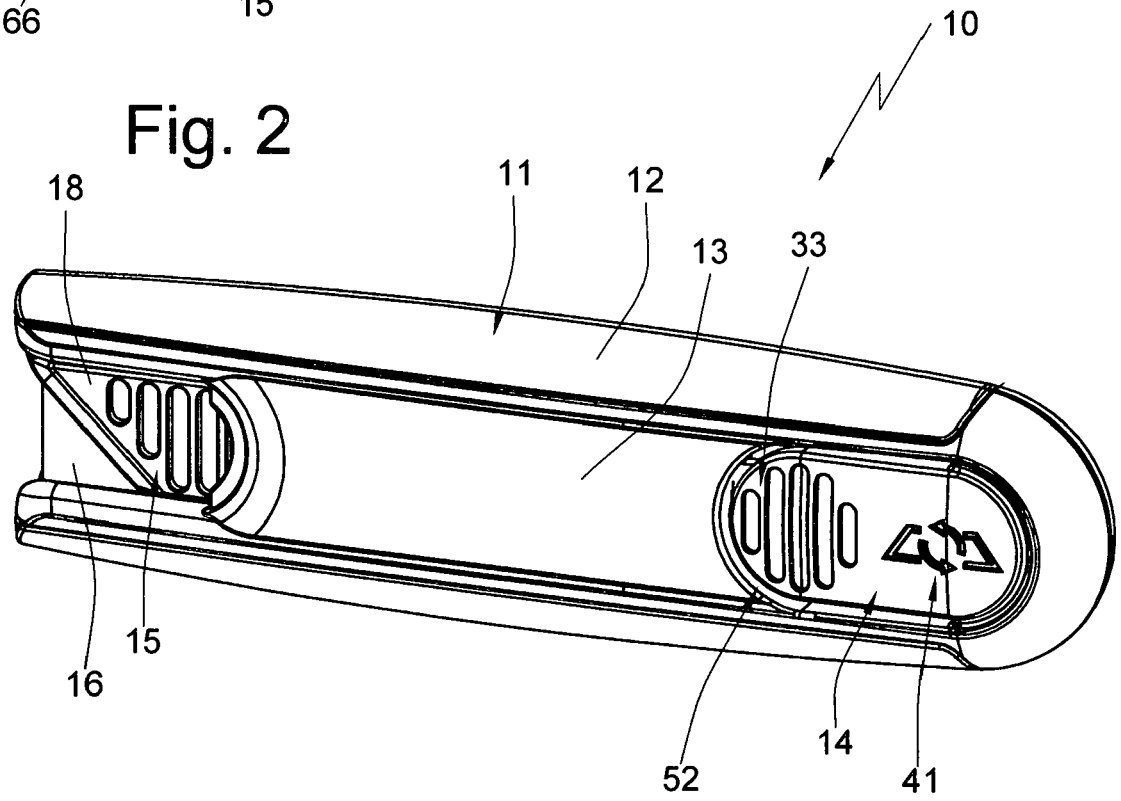
FIG. 2 is a schematic perspective view of the knife according to FIG. 1 from the rear.

The knife 10 has a housing 11 that comprises a first housing part 12, a second housing part 13 and a third housing part 54. The housing part 13 can be moved relative to the housing part 12 between a closed position and an open position. In interior of the housing 11 can be accessed in the open position such that a blade change can be carried out. The closed position is illustrated in FIGS. 1 to 5. The housing part 13 can be locked in the closed position by a locking mechanism V. The locking mechanism V needs to be unlocked in order to move the housing part 13 into the open position. FIG. 1 only shows an actuating button or actuator 14 of the locking mechanism V.

The knife 10 comprises a guiding device, by means of which the housing part 13 is guided on the housing part 12. According to FIG. 5, the housing part 13 is provided with a second guide web 38 in lateral regions 36 and 37, and each second guide web 38 is guided in a first guide groove 39 of the housing part 12. The guide webs 38 and the first guide grooves 39 form a longitudinal guide for the second housing part 13, by means of which the housing part 13 can be moved relative to the housing part 12 between the closed position illustrated in FIGS. 1 to 5 and the not shown open position in the directions $x_1$, $x_2$.

In addition to the actuating button 14, the locking mechanism V comprises an elastically deformable locking arm 28 (see FIG. 4) that is realized on the third housing part 54 of the housing 11. The locking arm 28 extends into the interior, for example approximately parallel to the longitudinal housing axis M. A free end region 29 points toward the front end of the knife, on which the outlet opening for the blade is arranged on the housing 11. The locking arm 28 is provided with a locking surface 30 on the end region 29. The locking surface 30 cooperates with a surface 31. The holding surface 31 is realized on a limit stop 32 of the housing part 13. In the locking position illustrated in FIG. 4, the locking surface 30 is arranged in the moving path of the holding surface 31. This is the reason why the second housing part 13 cannot be moved from the closed position into the open position in the direction $x_1$. Since a stop 64 of the second housing part 13 rests against a stop 58 of the first housing part 12 in the closed position according to FIG. 4, the second housing part 13 also cannot also be moved in the direction $x_2$.

In the illustrated embodiment shown, the actuating button 14 is formed by a region of the housing wall of the second housing part 13. However, the actuating button 14 is only attached to the second housing part 13 at an end region 41 while an opposite end region forms a free end 33 that is separated from other wall regions of the housing part 13 by a gap 52. When the free end 33 of the actuating button 14 is moved in the direction $z_1$, an actuating web 34 on the free end 33 presses on an upper outer surface 35 of the end region 29 and moves the locking arm 28, particularly the end region 29, out of the moving path of the holding surface 31 in the direction $z_1$ and into the release position indicated with a broken line in FIG. 4. Once the actuating button 14 is no longer actuated, the locking arm 28 springs back into its initial position in the direction $z_2$. As soon as the locking surface 30 is moved out of the moving path of the holding surface 31, the housing part 13 can be moved from the closed position illustrated in FIGS. 1 to 5 into the not-shown open position in the direction $x_1$. The open position is defined, for example by the cooperation of a stop of the first housing part 12 or of the blade support 15 with a stop of the second housing part 13. An intermediate position of the housing parts 12 and 13 is illustrated in FIGS. 6 to 10.

The knife 10 furthermore comprises a blade support 15, in which a blade 16 is held. The blade support 15 can be moved between a home position illustrated in FIG. 1 and a not shown cutting position.

Figure 4:
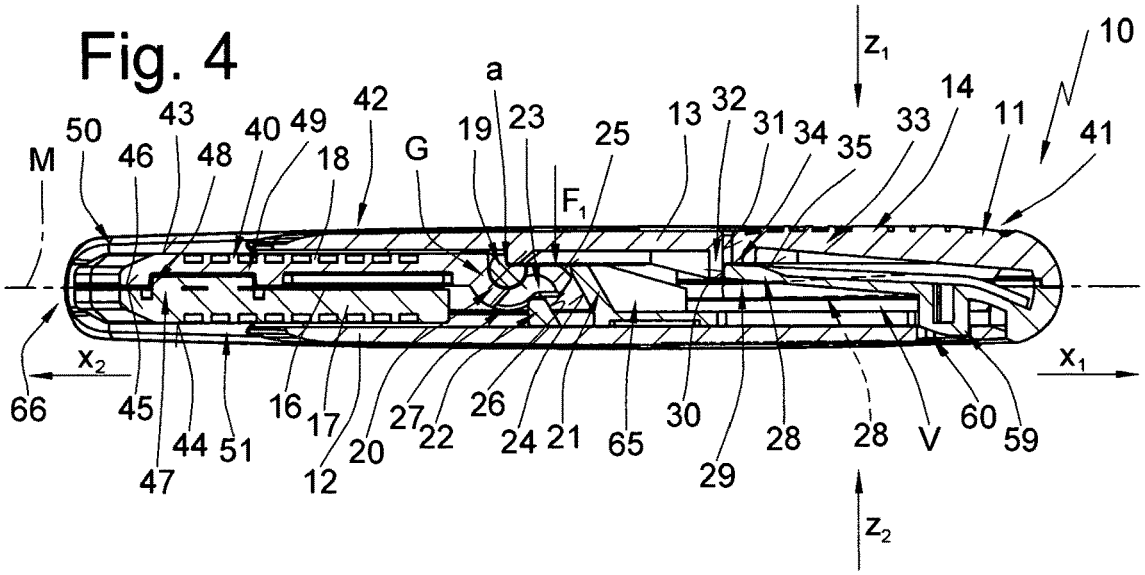
FIG. 4 is a schematic sectional view along the section line IV-IV in FIG. 3.
Figure 3:
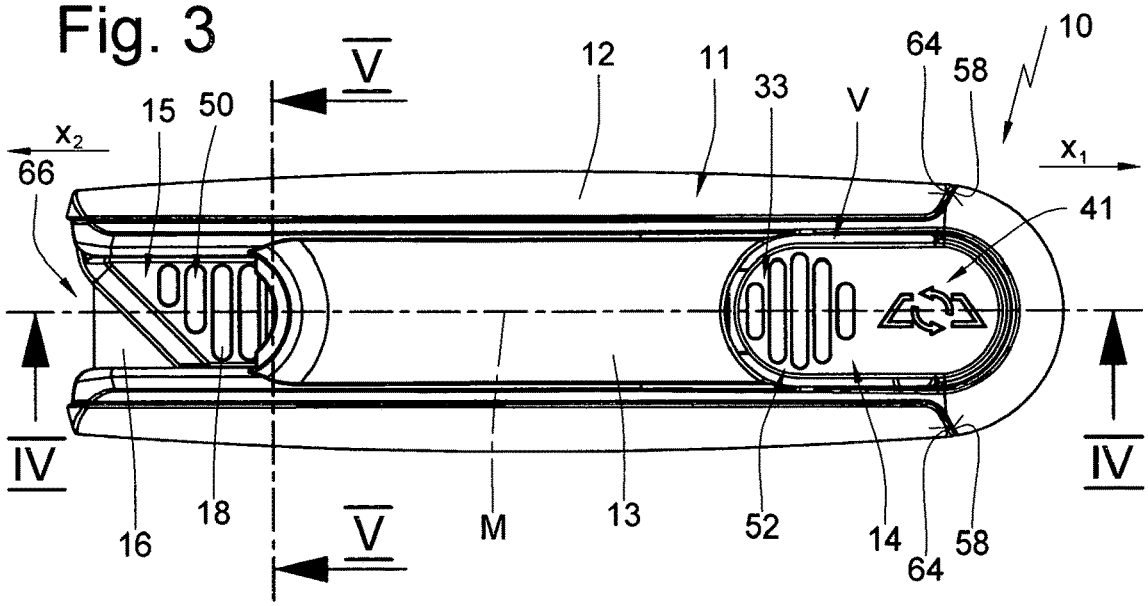
FIG. 3 is a schematic side view of the knife according to FIG. 1.
Figure 5:
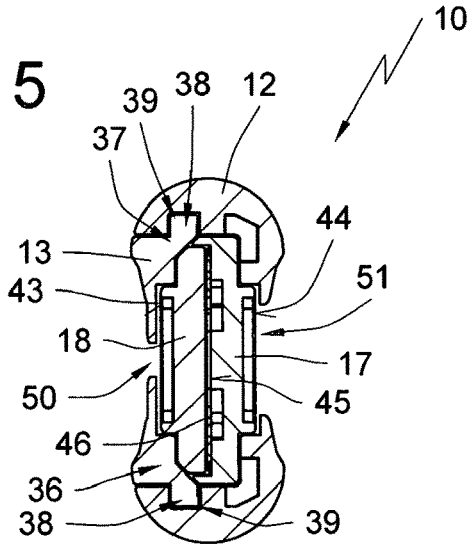
FIG. 5 is a schematic sectional view along section line V-V in FIG. 3.
Figure 6:
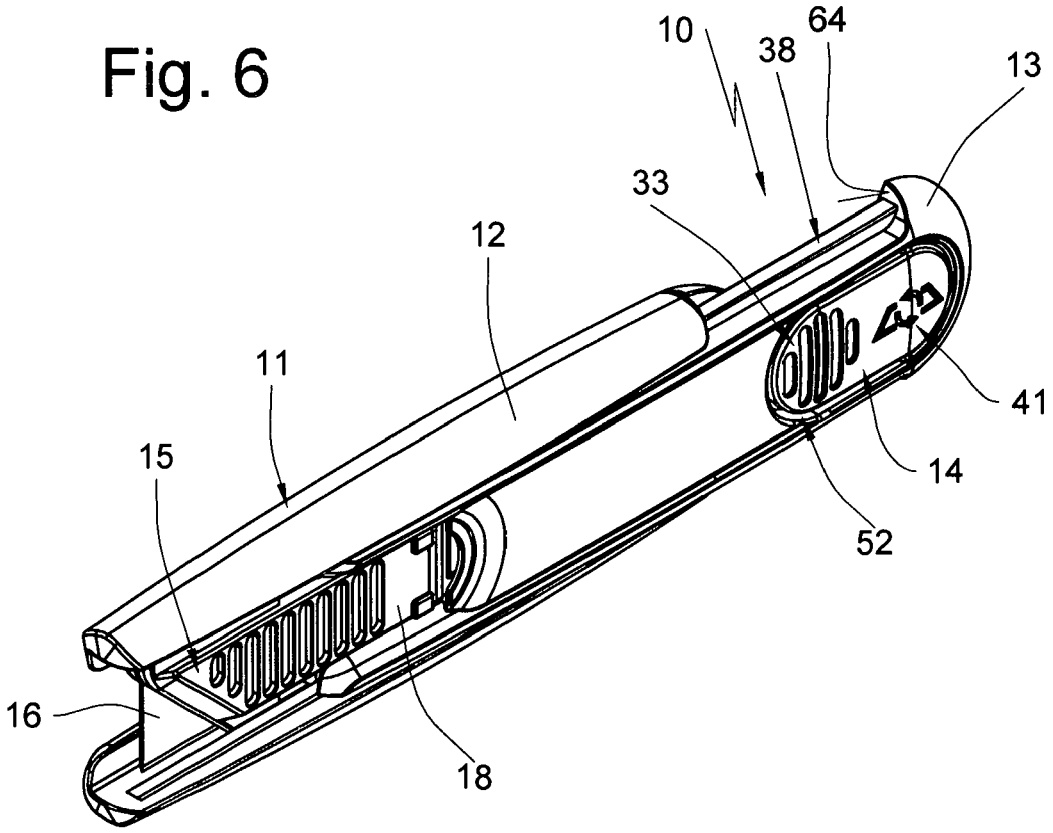
FIG. 6 is a schematic perspective view of the knife, in which the second housing part is in a position between the closed and the open position.
Figure 7:
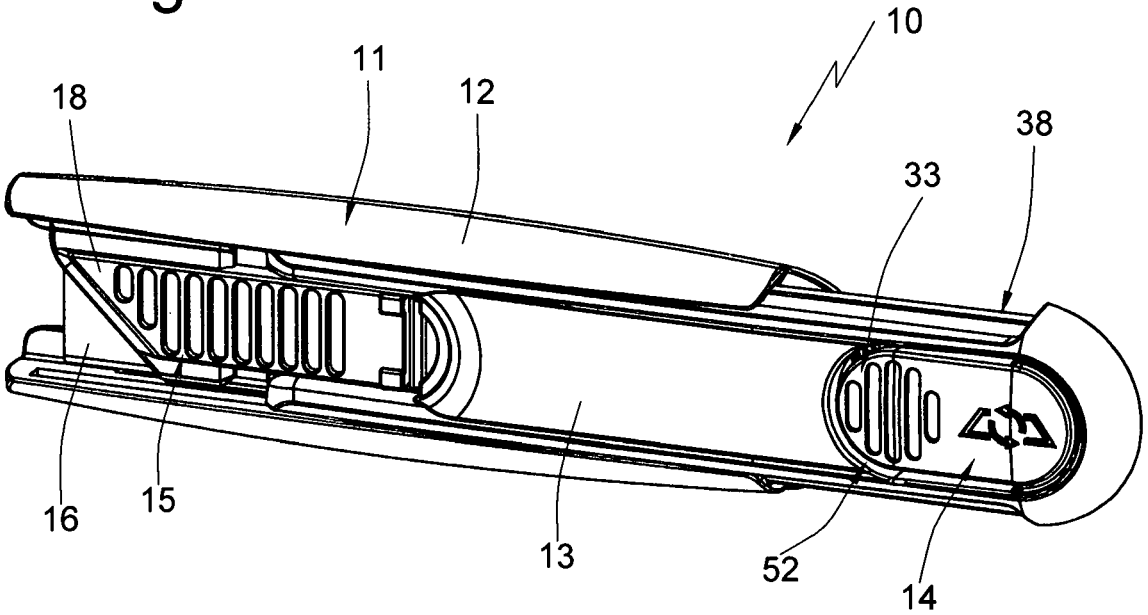
FIG. 7 is a schematic perspective view of the knife according to FIG. 6 from the rear.
Figure 9:
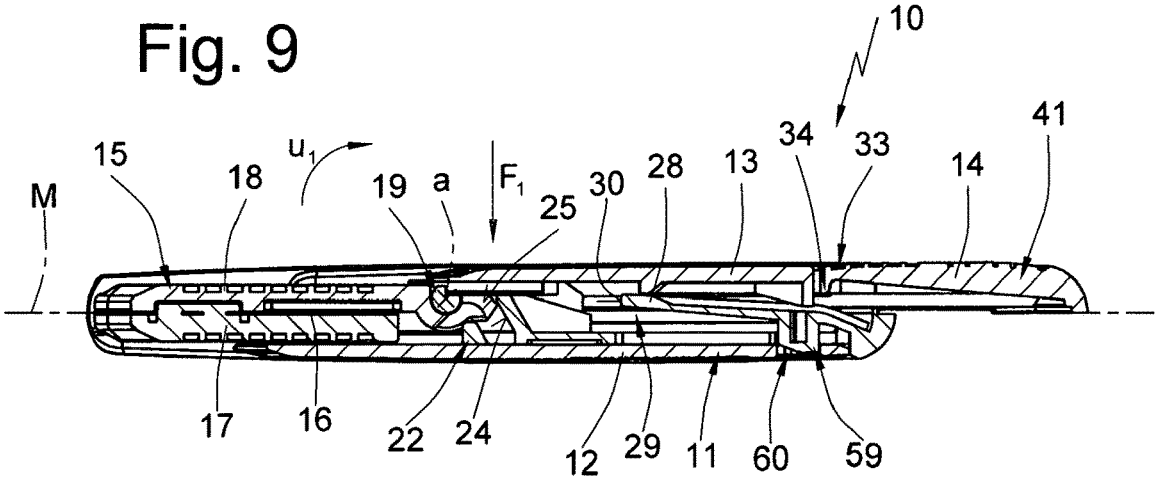
FIG. 9 is a schematic sectional view along the line of section IX-IX in FIG. 8.
Figure 8:
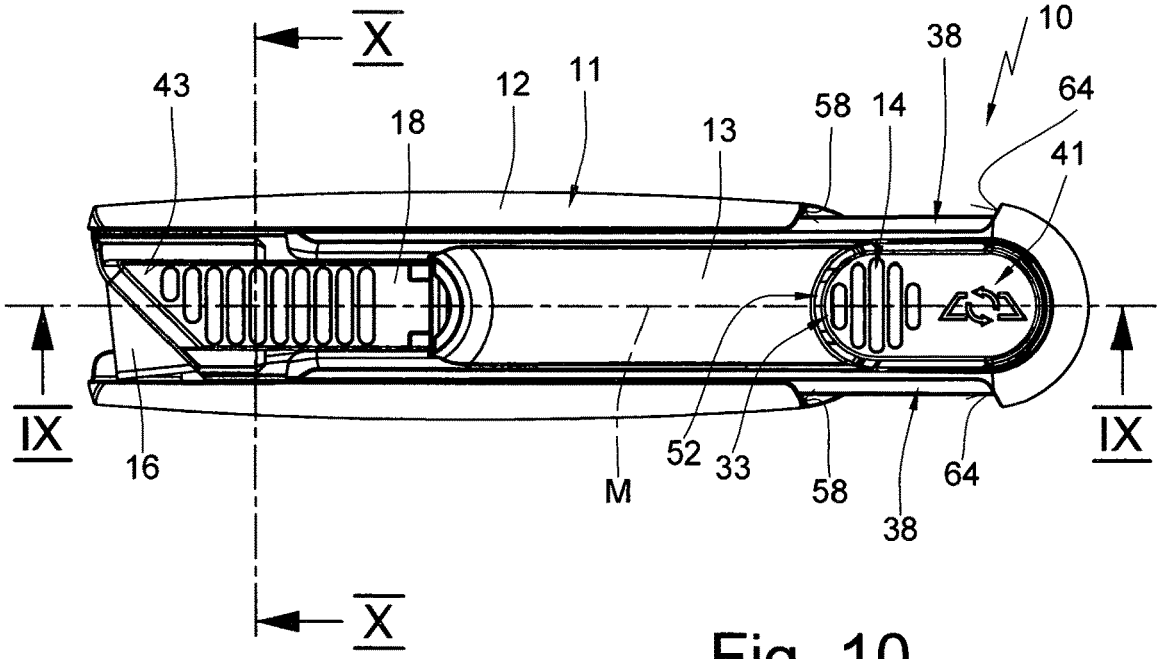
FIG. 8 is a schematic side view of the knife according to FIG. 6.
Figure 10:
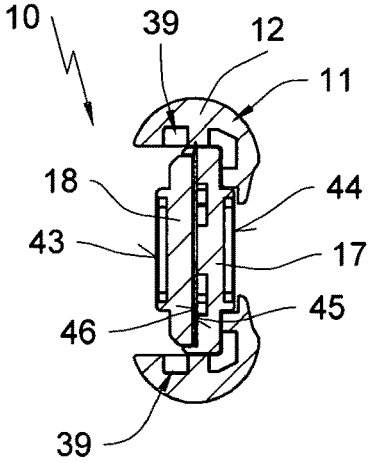
FIG. 10 is a schematic sectional view along the line of section X-X in FIG. 8.
Figure 11:
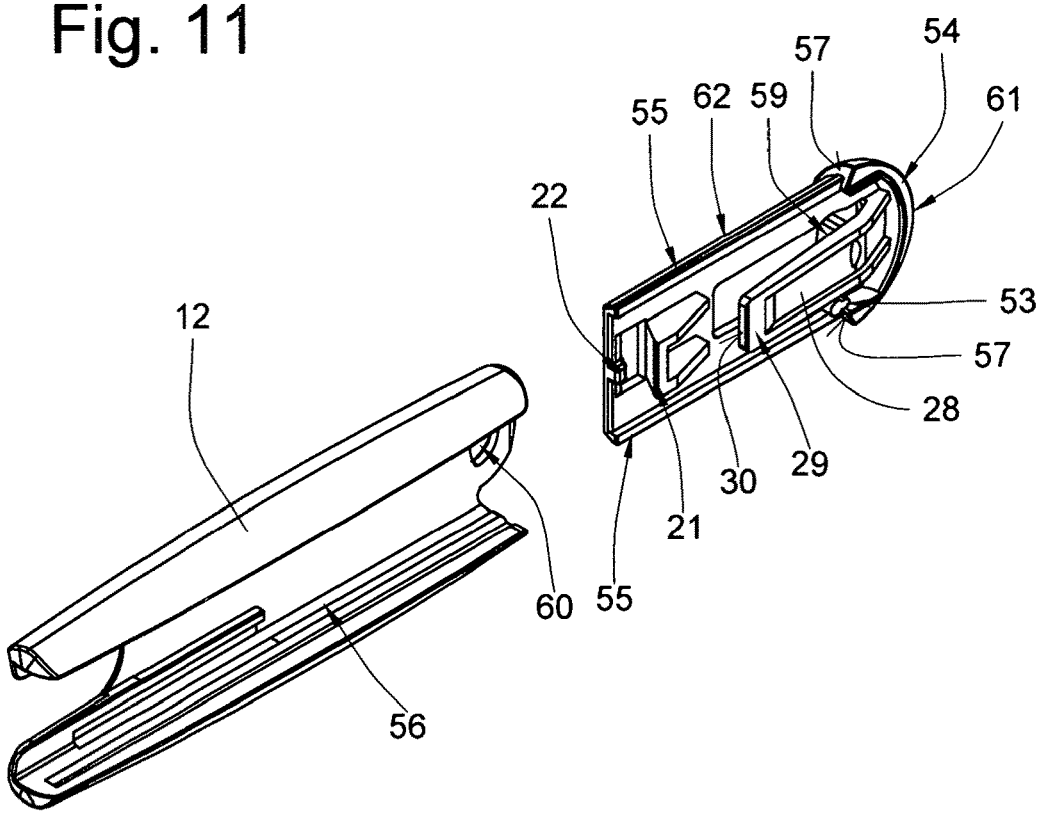
FIG. 11 is a schematic perspective exploded view of the first housing part and the third housing part.
Figure 12:
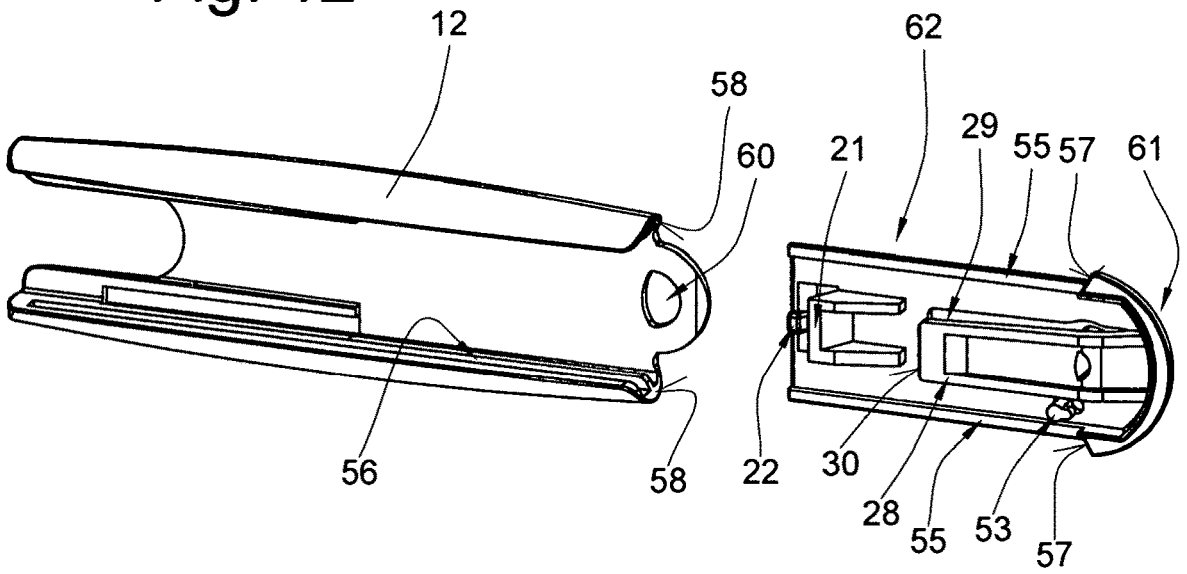
FIG. 12 is a schematic perspective exploded view of the housing parts according to FIG. 11 from the rear.
Figure 14:
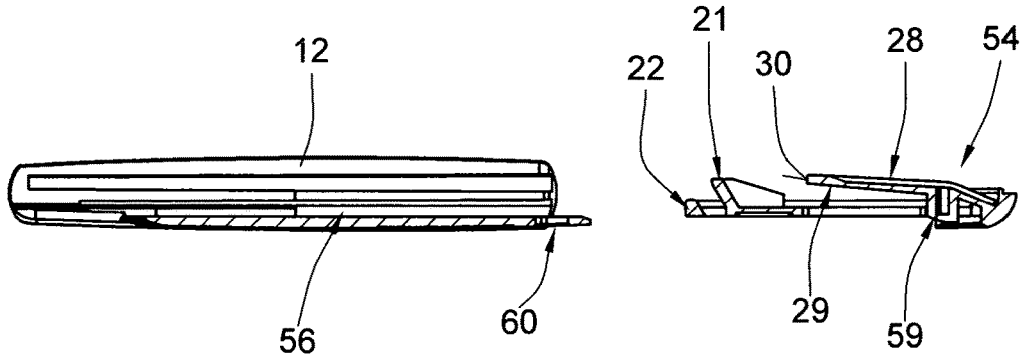
FIG. 14 is a schematic sectional view along the line of section XIV-XIV in FIG. 13.
Figure 13:
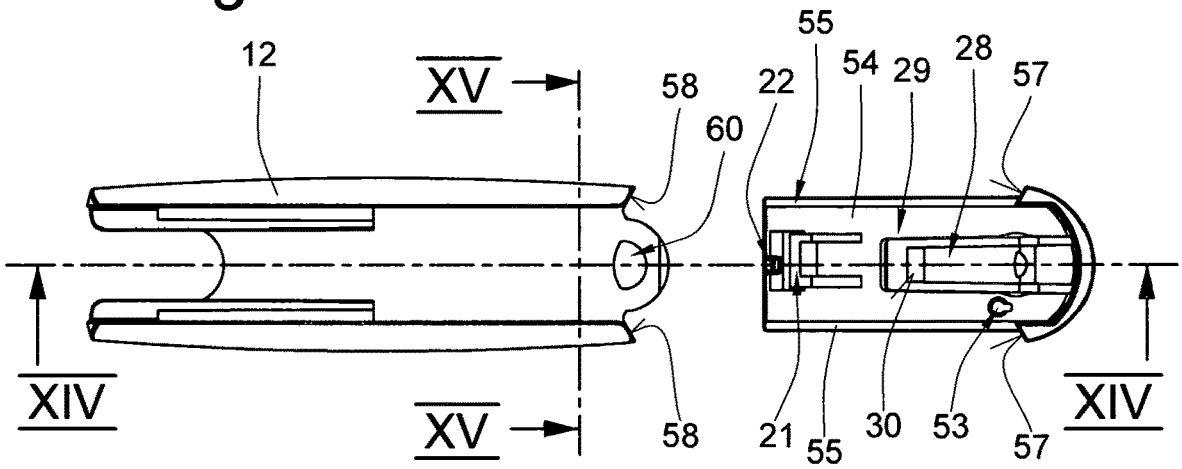
FIG. 13 is a schematic side view of the housing parts according to FIG. 11.
Figure 15:
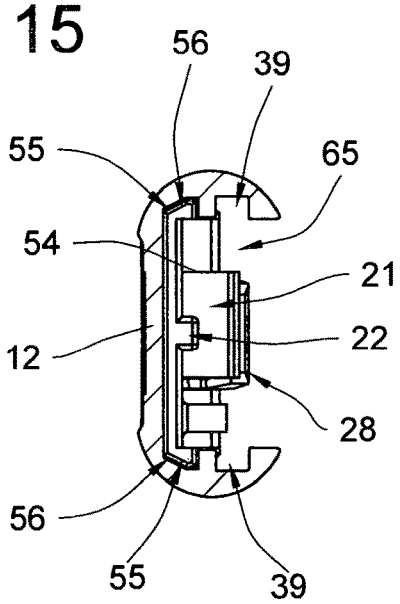
FIG. 15 is a schematic sectional view along the line of section XV-XV in FIG. 13.
Figure 16:
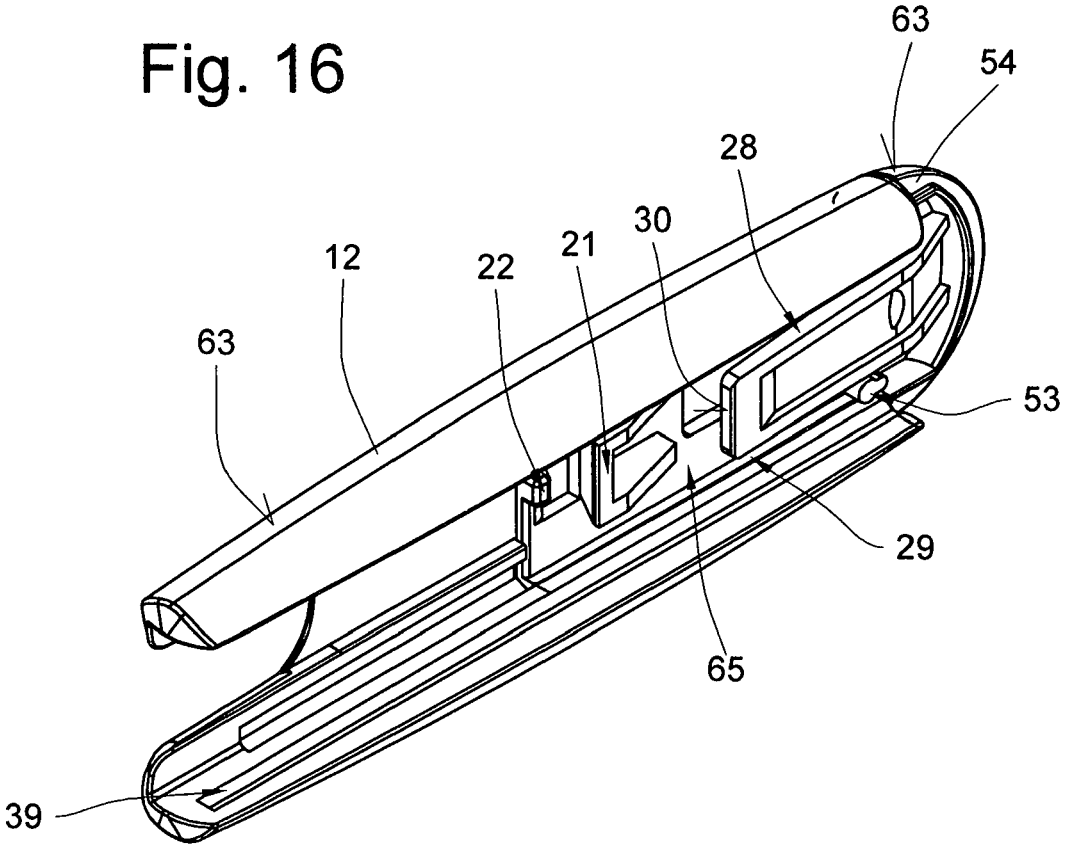
FIG. 16 is a schematic perspective view of the housing parts according to FIG. 11 in the assembled state.
Figure 17:
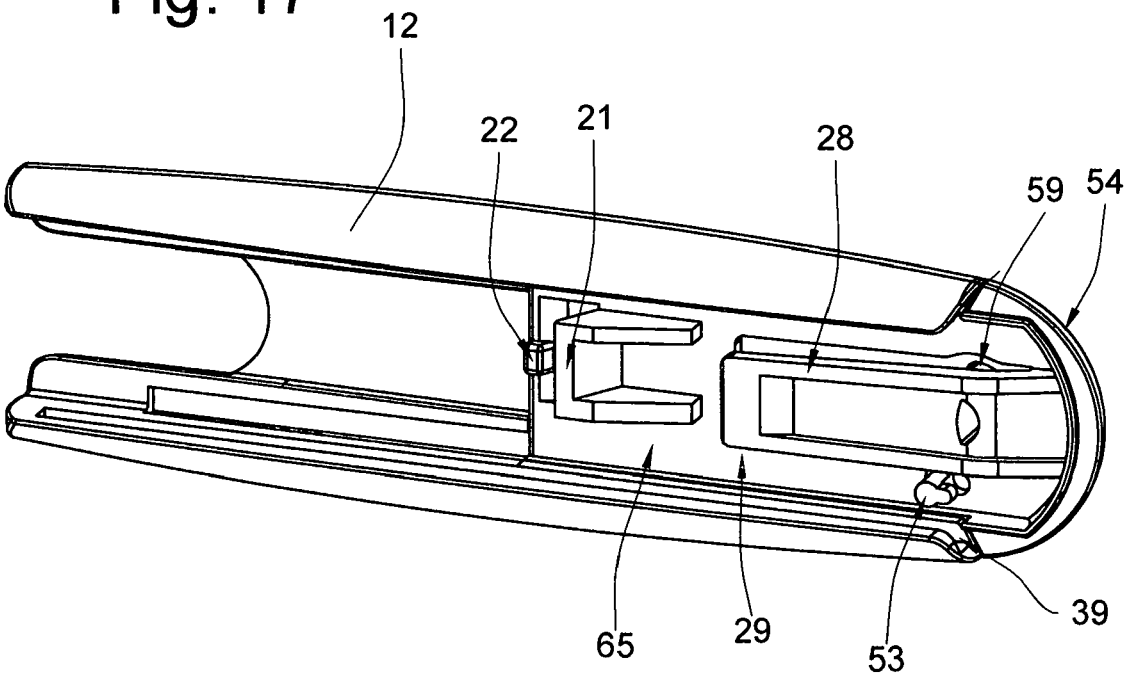
FIG. 17 is a schematic perspective view from the rear referred to FIG. 16.
Figure 19:
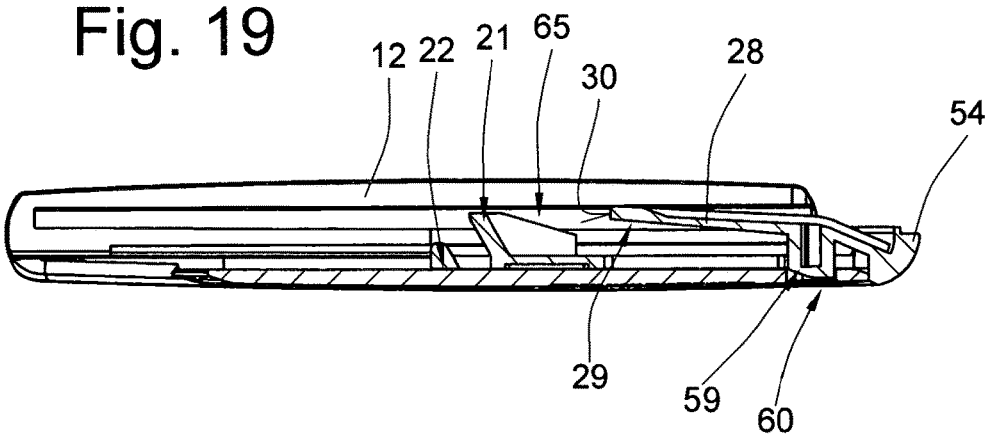
FIG. 19 is a schematic sectional view along the line of section XIX-XIX in FIG. 18.
Figure 18:
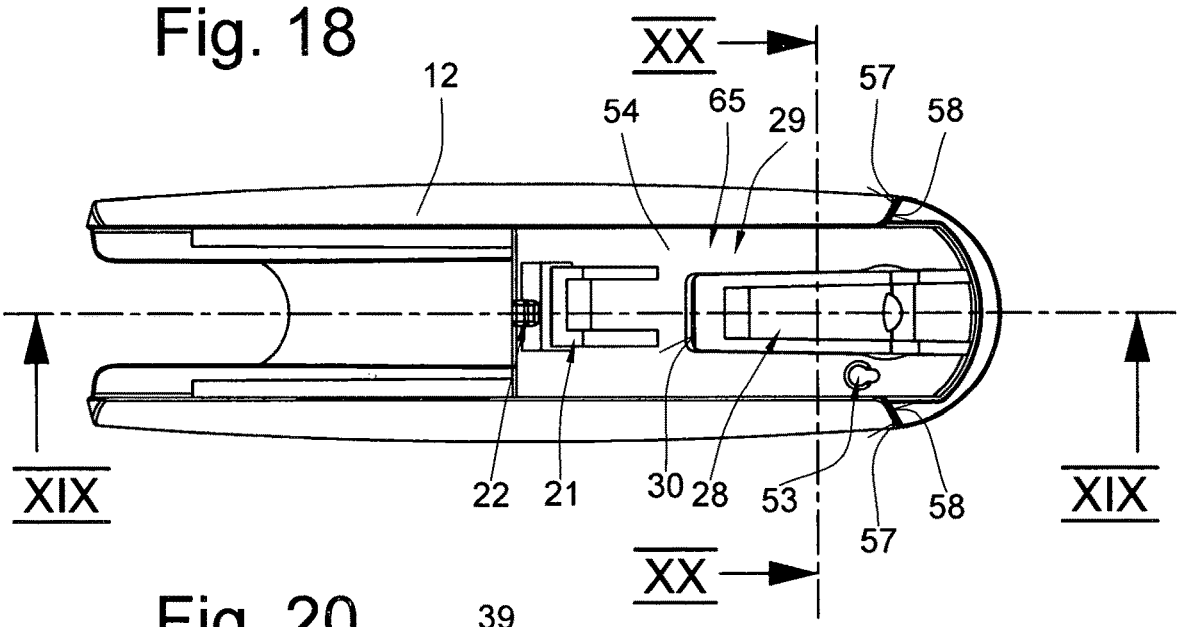
FIG. 18 is a schematic side view referred to FIG. 16.
Figure 20:
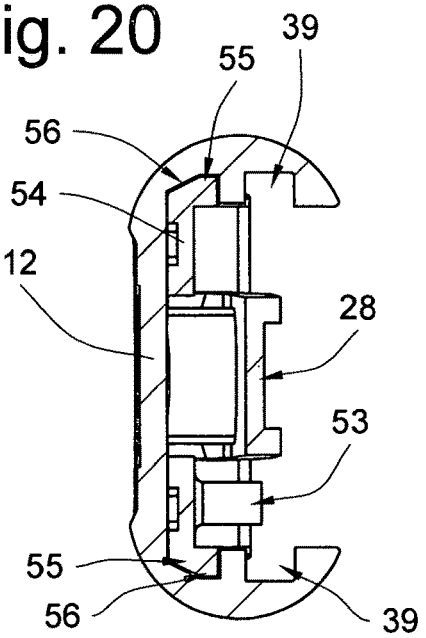
FIG. 20 is a schematic sectional view along the line of section XX-XX in FIG. 18.
Figure 22:
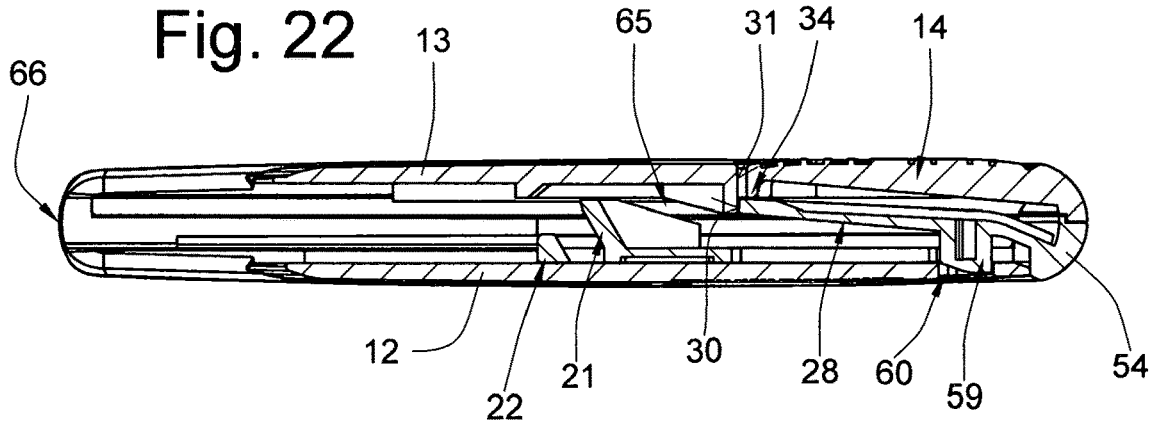
FIG. 22 is a schematic sectional view along the line of section XXII-XXII in FIG. 21.
Figure 21:
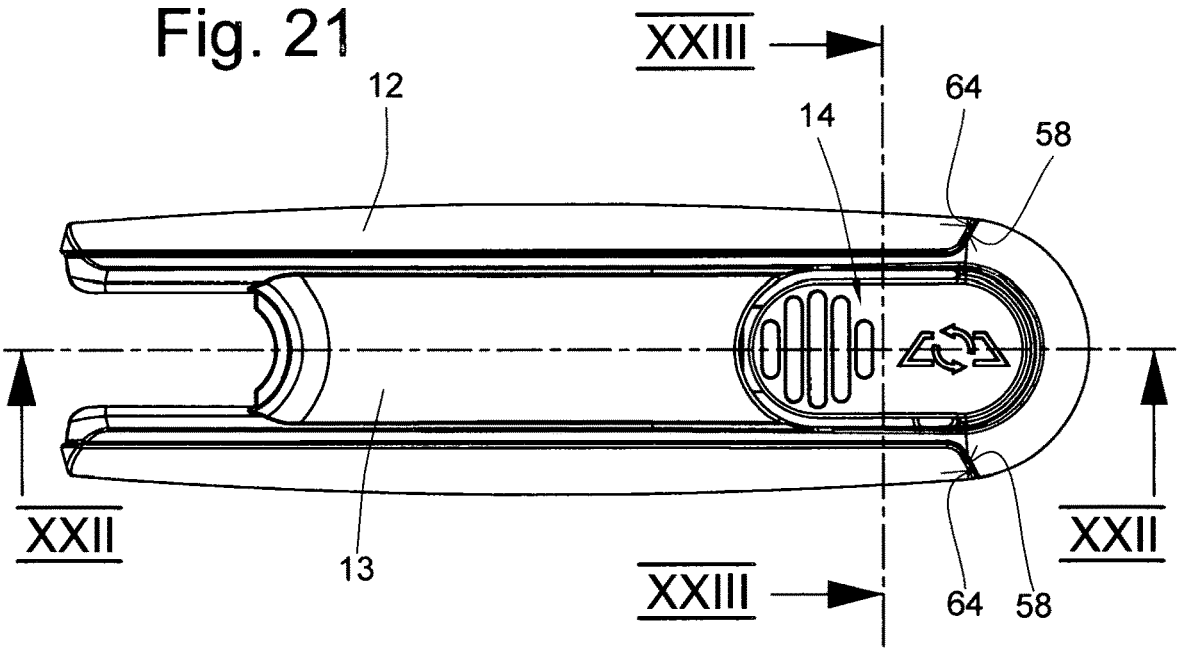
FIG. 21 is a schematic side view, in which the second and the third housing parts are installed on the first housing part and the blade support is not illustrated.
Figure 23:
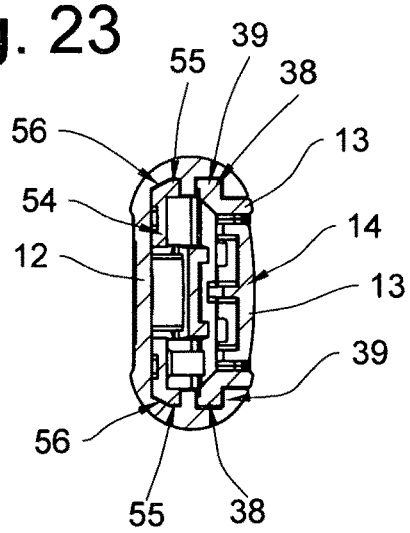
FIG. 23 is a schematic sectional view along the line of section XXIII-XXIII in FIG. 21.

FIG. 4 shows that the blade support 15 comprises a base part 17 and a holding part 18. In a holding position of the holding part 18, the blade 16 is held in a blade seat between a holding surface 45 of the base part 17 and a holding surface 46 of the holding part 18. In order to positively hold the blade 16, the base part 17 has a projection 47 that extends through an oblong hole 48 in the blade 16 and engages into a recess 49 of the holding part 18.

The holding part 18 can be pivoted relative to the base part 17 between the holding position and a changing position about a pivoting axis a. In the changing position, the blade can be removed from the blade seat, for example in order to be replaced with a new blade. The pivoting axis a is formed by a hinge structure 19 realized on the base part 17. A supporting structure 20 is realized on the holding part 18 and partially surrounds the hinge structure 19. The hinge structure 19 and the supporting structure 20 form a hinge joint G. The holding part 18 forms a two-armed lever, wherein a first lever arm is formed by an end region 23 and a second lever arm is formed by an end region 40.

A first abutment wall 21 and a second abutment wall 22 are realized on the third housing part 54 of the housing 11. The abutment walls 21 and 22 protrude into an interior 65 of the housing 11 and cooperate with the end region 23 of the holding part 18. The abutment surface 24 of the abutment wall 21 particularly cooperates with a surface area 25 of the end region 23 and an outer surface 26 of the abutment wall 22 cooperates with an inner surface of a recess 27 of the end region 23 as described in greater detail further below.

A not-shown spring is fixed on a not-shown fixing structure of the base part 17 and a fixing structure 53 of the housing part 12, wherein the spring prestresses the base part 17 in the direction $x_1$ and, in contrast to the illustration in the drawings, thereby presses the surface area 25 of the end region 23 against the abutment surface 24 of the first abutment wall 21. The abutment surface 24 is realized in the form of an inclined surface, i.e. it extends at an angle referred to the moving directions $x_1$, $x_2$. In this way, the abutment surface 24 exerts a force F1 upon the end region 23 in the direction $z_1$, wherein the force causes a torque about the pivoting axis a in the direction $u_1$. However, a front region 42 of the housing part 13 is according to FIG. 4 situated in the moving path of the end region 40 and prevents a pivoting movement of the end region 40 of the holding part 18 into the changing position in the direction $u_1$.

FIGS. 6 to 10 show an intermediate position of the housing part 13 between the closed position and the open position in which the holding part 18 is also unable to pivot in the direction $u_1$ because the front region 42 is situated in the pivoting path of the end region 40.

As soon as the housing part 13 has been moved in the direction $x_1$ to such an extent that the front region 42 is no longer situated in the moving path of the end region 40 (open position), the holding part 18 is able to pivot into the not-shown changing position about the pivoting axis a in the direction $u_1$. The blade 16 is now accessible and can be removed from the blade seat in order to be replaced with a new blade.

If the blade support 15 is moved in the direction $x_2$ in the changing position of the holding part 18, the inner surface of the recess 27 comes in contact with the outer surface 26 of the abutment wall 22. In this way, the abutment wall 22 prevents the blade support 15 from inadvertently moving in the direction $x_2$ and injuring the user during the blade change.

In order to pivot the holding part 18 from the changing position into the holding position, the housing part 13 is displaced from the open position in the direction $x_2$. A force is exerted upon a surface area 43 of the lever arm 40 in the direction $z_1$ by the front region 42. The force in the direction $z_1$ causes a torque that is directed opposite to the pivoting direction $u_1$ such that the holding part 18 pivots in the opposite direction of $u_1$. When the housing 13 is once again situated in the closed position according to FIGS. 1 to 5, the holding part 18 is pivoted back into its holding position and the lever arm 40 is held in the holding position by the housing part 13.

The blade support 15 needs to be moved in the direction $x_2$ in order to displace the blade support 15 from a home position illustrated in FIGS. 1 to 5, in which the blade 16 is arranged in the housing 11 such that it cannot injure the user, into a (not-shown) cutting position in which the blade 16 protrudes out of the housing 11. The housing 11 has recesses 50 and 51 on opposite sides for this purpose. The recesses 50 and 51 make it possible to take hold of and displace the blade support 15 in the direction $x_2$. The surface area 43 of the holding part 18 and a surface area 44 of the base part 17 are accessible through the recesses 50 and 51. The surface areas 43 and 44 are provided with a structure such that the blade support 15 can be taken hold of without slipping and moved out of a front opening 66 of the housing 11 in the direction $x_2$.

FIGS. 11 to 15 show the first housing part 12 and the third housing part 54. A rear region 61 of the third housing part 54 forms an outer housing surface 63 while a front region 62 comprises the first abutment wall 21, the second abutment wall 22, the locking arm 28 and the fixing structure 53. Second guide webs 55 are provided on the third housing part 54 in opposite lateral regions and cooperate with first guide grooves 56 of the first housing part 12 in such a way that the third housing part 54 can be inserted into the first housing part 12 and displaced relative to the first housing part 12 in the directions $x_1$, $x_2$. The third housing part 54 comprises a stopping shoulder 57 that cooperates with a stop 58 of the first housing part 12. The third housing part 54 furthermore comprises a snap-on projection 59 that can be separably engaged with a corresponding recess 60 of the first housing part 12. The snap-on projection 59 and the recess form a fixing device that is realized in the form of a snap-on mechanism in this case.

The assembly of the knife is described below:

According to FIGS. 11 to 20, the second guide webs 55 allowing displacement of the third housing part 54 are inserted into the first guide grooves 56 of the first housing part 12 and the housing part 54 is displaced relative to the housing part 12 in the direction $x_2$ until the stopping shoulder 57 comes in contact with the stop 58 and the snap-on projection 59 is engaged with the corresponding recess 60. The housing part 54 is then immovably and rigidly connected to the housing part 12.

Subsequently, the blade support 15 is arranged in its home position in the housing part 12. One end region of the not shown spring is fixed on the blade support 15 and another end region is fixed on the fixing structure 53. The second housing part 13 is then inserted into the first guide grooves 39 with its guide webs 38 and displaced in the direction $x_2$. During this process, the limit stop 32 passes the locking arm 28 and moves this locking arm out of the moving path of the limit stop 32. This is possible because the free end 29 of the locking arm 28 is provided with an inclined surface.

The housing parts are arranged in the closed position as soon as the stop 64 of the second housing part 13 rests against the stop 58 of the first housing part 12. In the closed position, the holding surface 31 engages behind the locking surface 30 of the locking arm 28. The locking mechanism V is in the locking position. In this position, a movement of the housing part 13 relative to the housing part 12 in the directions $x_1$ and $x_2$ is prevented.

The invention claimed is:

1. A knife comprising:

a first housing part;

a second housing part engaged to the first housing part for movement relative thereto along a path between an open position in which a housing interior is accessible and a closed position;

a holding surface fixed on and jointly movable with the second housing part;

a third housing part fixable on the first housing part and the second housing part is movably engaged with the third housing part;

an actuator movable on the second housing part between an actuated position and an unactuated position;

an arm that is integral with or fixed on the third housing part, operatively engaged by the actuator, and displaced on movement of the actuator between the unactuated position and the actuated position between a locking position securing the second housing part in one of the open and closed positions and a release position;

a locking surface on the arm and displaceable on movement of the arm between the locking position and the release position out of a path of movement of the holding surface of the second housing part; and positive locking structures on the third and first housing parts for fixing the third housing part on the first housing part.

2. The knife according to claim 1, wherein the arm has a free end and the locking surface is on the free end.

3. The knife according to claim 1, wherein the arm is prestressed into the locking position by a restoring force.

4. The knife according to claim 1, wherein the actuator is an elastic tab formed by a wall region of the second housing part.

5. The knife according to claim 1, wherein the first and second housing parts are configured to be guided relative to one another during the movement along the path.

6. The knife according to claim 1, wherein the first housing part has a first stop that cooperates with a second stop of the second housing part in order to limit movement of the first and second housing parts relative to each other.

7. The knife according to claim 1, wherein the second housing part is slidable relative to the first housing part.

8. A knife comprising:

a first housing part;

a second housing part engaged to the first housing part for movement relative thereto along a path between an open position in which a housing interior is accessible and a closed position; a blade support adapted to hold a blade, enclosed between the first and second housing parts in the closed position, and exposed in the open position for removal of the blade from the blade support;

a holding surface fixed on and jointly movable with the second housing part;

a third housing part housing part fixable on the first housing part and the second housing part is movably engaged with the third housing part;

an actuator movable on the second housing part between an actuated position and an unactuated position;

an arm that is integral with or fixed on the third housing part, operatively engaged by the actuator, and displaced on movement of the actuator between the unactuated position and the actuated position between a locking position securing the second housing part in one of the open and closed positions and a release position;

a locking surface on the arm and displaceable on movement of the arm between the locking position and the release position out of a path of movement of the holding surface of the second housing part; and positive locking structures on the third and first housing parts for fixing the third housing part on the first housing part.

* * * * *